US005138730A

United States Patent [19]

Masuda

[11] Patent Number: 5,138,730

[45] Date of Patent: Aug. 18, 1992

[54] MATTRESS HAVING CORE MATERIAL BETWEEN PROTECTIVE PLATES

[75] Inventor: Isamu Masuda, Fukuoka, Japan

[73] Assignee: Nihonkenkozoshinkenkyukai Co., Ltd., Fukuoka, Japan

[21] Appl. No.: 602,227

[22] PCT Filed: May 6, 1989

[86] PCT No.: PCT/JP89/00471

§ 371 Date: Nov. 2, 1990

§ 102(e) Date: Nov. 2, 1990

[87] PCT Pub. No.: WO90/13245

PCT Pub. Date: Nov. 15, 1990

[51] Int. Cl.[5] ..... A47C 27/15

[52] U.S. Cl. ..... 5/481; 5/464; 5/901

[58] Field of Search ..... 5/481, 448, 464, 431; 297/DIG. 1

[56] References Cited

U.S. PATENT DOCUMENTS

| | | | |
|---|---|---|---|
| 2,469,084 | 5/1949 | Schenker | 5/481 |
| 3,066,928 | 12/1962 | Lawrence | 5/481 |
| 3,118,153 | 1/1964 | Hood | 5/481 |
| 3,401,411 | 9/1968 | Morrison | 5/481 |
| 4,035,853 | 7/1977 | Platter | 5/481 |
| 4,143,435 | 3/1979 | Masuda | 5/481 |
| 4,509,219 | 4/1985 | Yagi | 5/481 |
| 4,580,301 | 4/1986 | Ludman | 5/481 |
| 4,673,452 | 6/1987 | Awdhan | 5/481 |
| 4,809,375 | 3/1989 | Bull | 5/448 |

FOREIGN PATENT DOCUMENTS

| | | | |
|---|---|---|---|
| 494494 | 11/1952 | Canada | 5/448 |
| 52-15765 | 2/1977 | Japan . | |
| 52-10568 | 3/1977 | Japan . | |
| 54-63713 | 5/1979 | Japan . | |
| 59-14811 | 6/1984 | Japan . | |
| 59-37228 | 10/1984 | Japan . | |

*Primary Examiner*—Renee S. Luebke
*Assistant Examiner*—F. Saether
*Attorney, Agent, or Firm*—Jordan and Hamburg

[57] ABSTRACT

A mattress has a core material (3) consisting of rigid foam material of a sufficient thickness, protective plates (4) (5) disposed on both upper and lower sides of the core material (3), and a surface layer material (6) (7) made of a cushioning material which is disposed on the protective plates (4) (5). At least one of the surface layer material (6) (7) is formed by disposing the second cushioning layer (11) consisting of semi-rigid cushioning material having an up-and-down face (13) on its surface on the first cushioning layer (10) made of flexible cushioning material.

12 Claims, 3 Drawing Sheets

MATTRESS HAVING CORE MATERIAL BETWEEN PROTECTIVE PLATES

TECHNICAL FIELD

The present invention relates to a mattress. Particularly, it relates to a mattress wherein metal component parts such as coiled springs are not incorporated.

TECHNICAL BACKGROUND

Conventionally, the mattress has a structure wherein multiple coiled springs are fixed on the metal frames to both upper and lower sides, and sheeting materials are laid over it, then enclosing the entire body with a covering cloth.

This kind of mattress contains metal frames and multitude of coiled springs, which makes it very heavy and inconvenient to handle. Moreover, coiled springs and metal frames generates rust and gives breakages and damages to the sheeting and covering cloth, often causing a short life of the mattress and bad influence to the comfortableness in the use of the mattress.

Furthermore, in this kind of mattress too much emphasis is placed only to sustaining user's body stably, and attention is barely paid to promoting the users' health.

The present invention avoids using metal components, and by employing rigid foam as the core material and by piling surface layer materials consisting of cushioning materials over the core material, it renders to make the mattress light in weight and long in life, besides improving comfortableness in use of this mattress.

SUMMARY OF THE INVENTION

In a cushioning mattress enclosed in a cover of sheet form for the entire external contour of its main body, said main body of the mattress is constructed of a core material consisting of a rigid foam material of sufficient thickness, protective plates piled on both upper and lower sides of said core material, and surface layer materials piled on the protective plates.

Furthermore, in the mattress in accordance with this invention, at least one of the surface layer materials is formed by piling a second cushioning layer consisting of semi-rigid cushioning material which has an up-and-down surface over the first cushioning material.

The mattress in accordance with this invention uses no metal component parts such as coiled springs and employs rigid foam as the core material in the main body, which contributes to reduce the weight of the mattress, making it convenient to handle. Accompanying no problem of rusting and breaking, the mattress endures a long life, and no bad influence is seen in comfortable use of the mattress.

In addition, since the core material is covered by the protecting plates, there is no risk of the core material being damaged by an external force, making the mattress superior in enduring property. Moreover, as the protecting plates have the function of preventing the user's body from sinking into the mattress, the body is sustained in natural form to assure sound sleeping.

According to the accompanying second invention, the first cushioning layer gives appropriate cushion to the body, and the second cushioning layer sustains the body with contacting spots on its up-and-down level surface, assuring space for excellent ventilation and damp releasing performance to secure comfortable feeling of use. In addition, finger-pressing massaging effect with the projecting parts will affect the body to help good blood circulation to the promotion of health.

BRIEF DESCRIPTION OF THE INVENTION

DETAILED DESCRIPTION OF THE PREFERRED EMBODIMENTS

Figure 1:
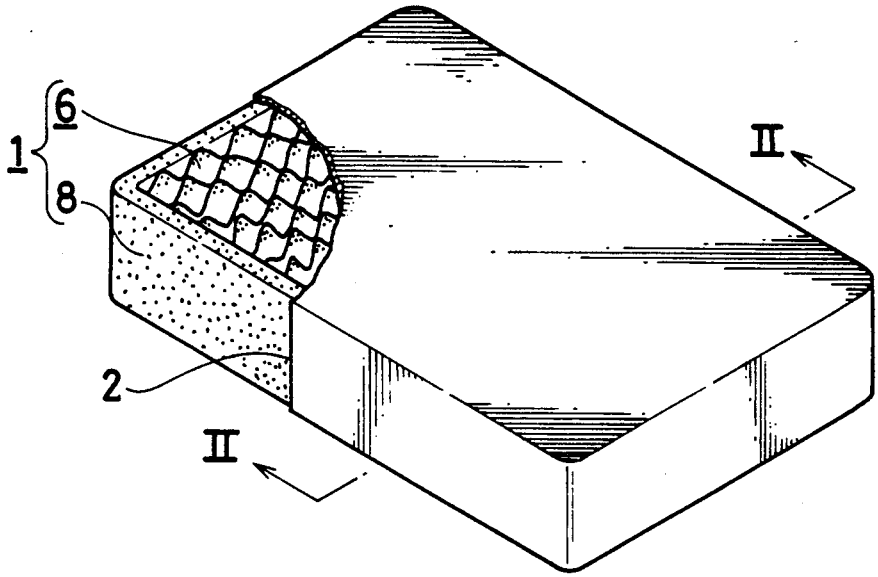
FIG. 1 is a perspective view of the mattress according to one embodiment of the invention with a part of the cover broken away.
Figure 2:
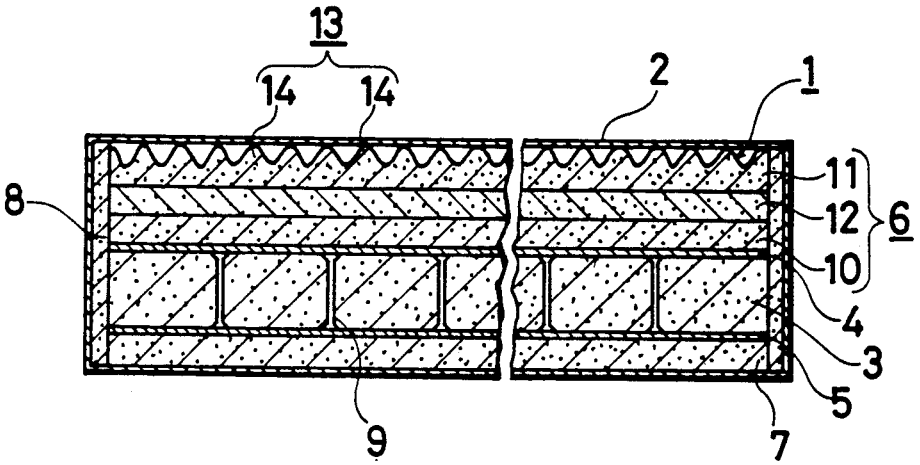
FIG. 2 is a cross-sectional view taken along the line II—II in FIG. 1.

FIGS. 1 and 2 show a mattress relative to an embodiment in accordance with the present invention, wherein the entire external contour of the main body of cushioning mattress being enclosed in cover 2 of sheet form.

Figure 3:
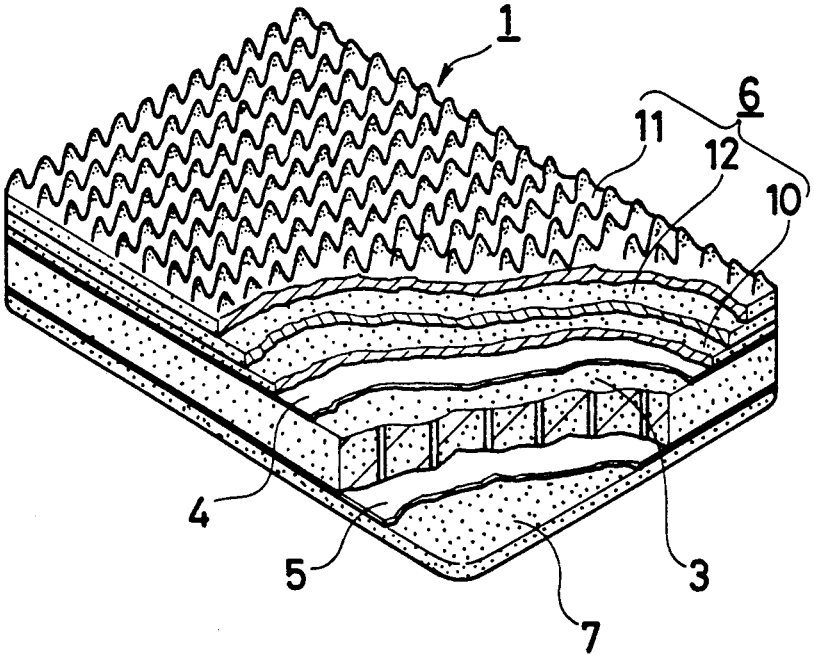
FIG. 3 is a perspective view of all layers constructing the mattress with a part of each layer broken away.

As shown in FIG. 2 and 3, the main body of said mattress 1 is constructed with the core material 3 as the middle layer, on both sides of which protective plates 4 and 5 are piled, and further on them surface layer material 6 and 7 are covering respectively and the external vertical sides are covered with peripheral wall material 8. Between the core material 3 and each protecting plates 4 and 5, between each protecting plates 4 and 5 and surfacing layer materials 6 and 7, and between these laminated body and external wall material 8, adhesives are bonding them together respectively into one unit.

The core material 3 being made of light weight rigid foam material, it is set to form about ½ in proportion to thickness of the mattress. Core material contributes not only to reduce the weight of the mattress, but also it has the function to avoid deformation of the mattress as a whole, keeping the thickness of the mattress.

A multiple number of ventilation holes 9 are bored on both sides of the core material 3, avoiding the damp air from staying put within the main body of the mattress.

The protective plate 4 on the surface side employs strong and difficult to deform compressed plywood of several mm thickness and will prevent the core material from forcibly breaking down under the load of the weight of human body and help avoid the body from sinking into deformed elasticity of the surface layer material 6. As for the protecting plate 4, a corrugated plastic plate may be also used instead of the above-mentioned compressed plywood, as far as it has a sufficient strength.

The protective plate 5 on the back side is for protecting the core material 3, likewise as the protective plate 4 on the surface side. In the case of this embodiment, however, a light-weight and damp-absorbing paper board may be used, although it is inferior in strength, because of up/down sides are predetermined for this embodiment.

In this embodiment, the surface layer material 6 on the upper side uses a cushioning material in 3 layers of different kind. The structure is of 3 layers; the first cushioning layer 10 is the lowermost layer, the uppermost layer being the second cushioning layer 11, and the middle layer is the third cushioning layer 12.

The first cushioning layer 10 is made of a flexible and ventilating cushioning material such as flexible polyurethane foam and gives strong cushioning effect to the user's body by sufficiently deforming elastic layer under the load.

Figure 4:
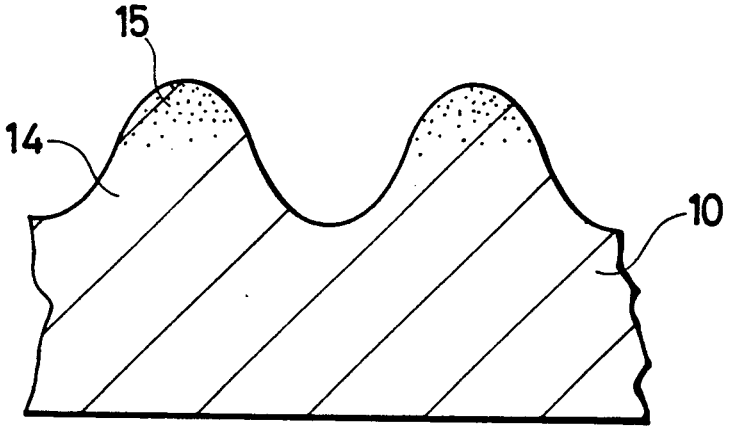
FIG. 4 is a cross-sectional view of the second cushioning layer that is magnified.

The second cushioning layer 11 is made of a rather weak cushioning quality material and concurrently of an appropriate rigidity but having a semi-rigid cushioning material like semirigid urethane foam that is provided with ventilating property which sustains the human body by deforming in a small way under the load. For this cushioning material, for instance, "RUBBERTAN H", a product by Toyo Rubber Chemical Industry Co. Ltd., made from polyether and rubber as the main raw material, is suitable. On its entire surface, an up-and-down surface 13 is formed. Each projection on this surface 13, solidified hardened portions 15 are provided as shown in FIG. 4 and the hardened portion 15 are made by impregnating rubber liquid or the like at the top of the projection 14 and then solidified by subjecting to heating process at about 100° to vulcanize the rubber liquid part. By dint of this hardened portion 15, the projection 14 will not be squashed under the load and the body can be sustained in a condition of contact with points, thus generating space between the body and the cushioning material for good ventilation and giving finger-pressing massaging effect.

The third cushioning layer 12 is formed by compressing urethane chip at a high temperature and has a medium degree of cushioning property to support the body and reinforce the strength of the surface material 6.

The back side surface material 7 and the peripheral vertical wall material 8 is of the same material as abovementioned first cushioning material. The surface layer material 6 gives a forceful cushioning by sufficiently deforming under the load. The peripheral vertical wall material 8 protects the laminated structure of the mattress from the outside force.

Figure 5:
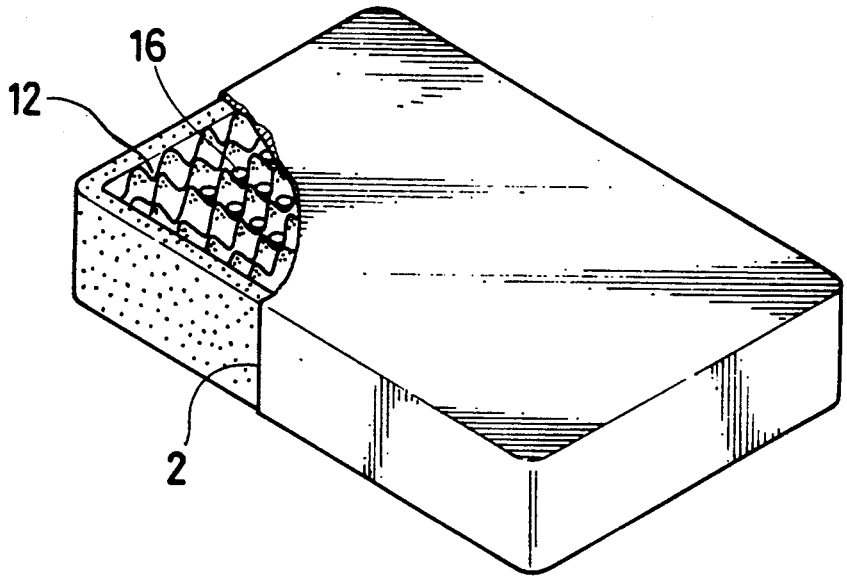
FIG. 5 is a perspective view showing a part of the cover broken away of the mattress in accordance with another embodiment of the invention.

FIG. 5 shows another embodiment of the invention and represents a mattress provided with a multiple number of permanent magnets 16 on the upper side surface layer material 6. By applying magnetic line of force to the body, these permanent magnets 16 are intended to obtain a certain defined magnetic therapeutical effect. They are fixed with adhesives at the dented portion of the up-and-down surface 13 in the second cushioning layer 11.

UTILITIES IN APPLICATION TO INDUSTRIES

The mattress in accordance with this invention is installed on a bed and is used with covering of the bed sheet. When a user lies on this mattress, mainly the surface layer material 6 of the first cushioning layer 10 at the upper side and the surface layer material 7 at the side give the cushioning effect and the second cushioning layer 11 supports the body. In this case, the protective plates 4 prevents the body from sinking in unnatural shape to the elastic deformation of the main body of the mattress.

Furthermore, the second cushioning layer 11 is provided with the hardened part 15 at the top of the projection 14 on the up-and-down surface 13, and each projection will not be squashed under the load of body and the body is supported by the hardened parts 15 of the projection 14 with the contact points. For this reason, the vacant space between the body and the cushioning layer 11 of the second cushioning layer is kept to assure ventilation and damp releasing, promoting comfortable feel of use. Moreover, each projection 14 on the up-and-down surface 13 will press appropriate portions of the body, giving finger-pressing massaging effect and encouraging blood circulation to help promote the health.

In an embodiment as shown in FIG. 5, the magnetic line of force radiating from the permanent magnets 16 will affect the human body and further promotes the blood circulation, rendering to eliminate stiffness of muscles and to recover from fatigue.

For transporting this mattress, the weight is reduced with no metal components used in the main body 1 and rigid foam material used, so the handling is very easy. There is no risk of generating any rust and inviting damage, and the mattress is superior in endurance of life and gives excellent feel of use.

What is claimed is:

1. A mattress devoid of coil springs comprising a core foam material, said core foam material having an upper side and a lower side, upper and lower protective plates disposed on said respective upper and lower sides such that said core foam material is sandwiched between said upper and lower protective plates, upper cushioning material disposed on said upper protective plate, and lower cushioning material disposed on said lower protective plate, said upper cushioning material comprising a first cushioning layer and a second cushioning layer, said first cushioning layer being disposed between said second cushioning layer and said upper protective plate, said first cushioning layer being less rigid than said second cushioning layer, said second cushioning layer having an upper surface formed by a plurality of spaced projections, said upper cushioning material further comprising a third cushioning layer between said first and second cushioning layers, said third cushioning layer having a rigidity which is intermediate said first and second cushioning layers, and a side cushioning material disposed along the sides of said mattress.

2. A mattress according to claim 1, wherein at least one of said upper and lower protective plates comprises plywood.

3. A mattress according to claim 1, wherein said upper protective plate comprises plywood.

4. A mattress according to claim 1, wherein at least one of said upper and lower protective plates comprises a plastic plate.

5. A mattress according to claim 4, wherein said plastic plate is corrugated.

6. A mattress according to claim 1, wherein at least one of said upper and lower protective plates comprises paper board.

7. A mattress according to claim 1, wherein said core foam material has a plurality of ventilating holes extending between said upper and lower sides of said core foam material.

8. A mattress according to claim 1, wherein said lower cushioning material is made of the same material as said first cushioning layer.

9. A mattress according to claim 1, where said side cushioning material is made of the same material as said lower cushioning material and of the same material as said first cushioning layer.

10. A mattress according to claim 1, wherein each of said projections has a top portion which is hardened with a hardening material such that said hardened top portions are harder than the remaining portions of said second cushioning layer.

11. A mattress according to claim 10, wherein said cushioning layer comprises a foam material, said hardening material comprising rubber.

12. A mattress according to claim 1 further comprising magnets on said second cushioning material.

* * * * *